United States Patent [19]

Okuyama et al.

[11] Patent Number: 4,658,770

[45] Date of Patent: Apr. 21, 1987

[54] SUPPORTING STRUCTURE FOR ROCKER ARMS FOR ENGINE VALVES

[75] Inventors: Takahiro Okuyama, Tokyo; Susumu Toki, Saitama; Keiji Tanabe, Aichi, all of Japan

[73] Assignees: Honda Giken Kogyo Kabushiki Kaisha, Tokyo; Tokai TRW and Co., Ltd., Aichi, both of Japan

[21] Appl. No.: 781,120

[22] Filed: Sep. 27, 1985

[30] Foreign Application Priority Data

Sep. 27, 1984 [JP] Japan ..... 59-202473

[51] Int. Cl.[4] ..... F01L 1/18

[52] U.S. Cl. ..... 123/90.41; 123/90.27; 123/90.43; 123/90.44

[58] Field of Search ..... 123/90.27, 90.41, 90.43, 123/90.44, 90.45, 90.39

[56] References Cited

U.S. PATENT DOCUMENTS

| | | | |
|---|---|---|---|
| 2,970,585 | 2/1961 | Lombardi | 123/90 |
| 3,166,058 | 1/1965 | Zink | 123/90.44 |
| 3,532,080 | 10/1970 | Sarata | 123/90.27 |
| 3,563,215 | 2/1971 | Ross | 123/90.44 |
| 3,563,216 | 2/1971 | Uemura | 123/90.44 |
| 3,602,205 | 8/1971 | Turkish | 123/90.65 |
| 3,618,574 | 11/1971 | Miller | 123/90.44 |
| 3,656,461 | 4/1972 | Renger et al. | 123/90.42 |
| 3,672,338 | 6/1972 | Yamanouchi | 123/90.27 |
| 4,203,397 | 5/1980 | Soeters | 123/90.16 |
| 4,369,740 | 1/1983 | Seidl | 123/90.44 |

FOREIGN PATENT DOCUMENTS

| | | | |
|---|---|---|---|
| 3219611 | 12/1982 | Fed. Rep. of Germany | 123/90.44 |
| 16482 | 6/1965 | Japan . | |
| 133408 | 8/1983 | Japan | 123/90.44 |

*Primary Examiner*—Ira S. Lazarus

*Attorney, Agent, or Firm*—Irving M. Weiner; Joseph P. Carrier; Pamela S. Burt

[57] ABSTRACT

A supporting structure for rocker arms for engine valves includes an engine having a cylinder head, a valve provided on the cylinder head and adapted for either of intake and exhaust purposes, a valve-operating mechanism for operating the valve, the valve-operating mechanism including a rocker arm abutting on the top of the valve, to thereby operate the valve, and a pivotal structure for pivotably supporting one end of the rocker arm. The pivotal structure comprises a ball-like portion, a spherical concave portion shaped in a form substantially correspondent to the ball-like portion and engaged with the ball-like portion, and an elastic member disposed at an aperture end of the spherical concave portion and adapted to hold the ball-like portion in the spherical concave portion.

11 Claims, 5 Drawing Figures

SUPPORTING STRUCTURE FOR ROCKER ARMS FOR ENGINE VALVES

BACKGROUND OF THE INVENTION

1. Field of the Invention

The present invention generally relates to a supporting structure for rocker arms for engine valves. More particularly, the invention relates to a supporting structure for a rocker arm constituting a valve-operating mechanism for valves of an internal combustion engine.

2. Description of Relevant Art

In the valve-operating mechanisms of internal combustion engines, there have been employed several varieties of rocker arms for actuation of engine valves. Exemplarily of such rocker arms is a seesaw type rocker arm rockably supported with a support shaft, one arm end thereof cooperating with a cam and the other arm end abutting on the head of a valve stem. The necessity of the support shaft in this mechanism has complicated the structure and increased the number of component parts required in addition to the shaft. Further the disposition of the cam to be present at one end of the rocker arm and that of the valve stem at the other end thereof have enlarged the total arm length, resulting in larger dimensions than desired of the valve-operating mechanism, as well as of the entirety of engine.

In this respect, there have been already put to practical use a number of end-pivot type rocker arms employing no support shafts, which were proposed exemplarily in U.S. Pat. Nos. 3,166,058 and 2,970,585 and Japanese Utility Model Publication No. 40-16482.

In U.S. Pat. No. 3,166,058, however, the rocker arm was adapted to swing on a pivot member which was pivotally engaged in a spherical concave surface of the arm, merely in a semi-sunk manner. With this structure it was discovered that in a high rotation speed region the concave surface might undesirably experience lift-off actions relative to a ball-like portion as a pivotal part of the pivot member, thereby producing noises. Additionally, other disadvantages, such as in the assembly process, were attendant this rocker arm. A particular assembly-associated problem results from the fact that this rocker arm comprised only the concave surface at its base part for abuttingly receiving the ball-like portion and was also simply brought into abutment at its distal end with the head of a valve stem, whereby the arm had a tendency to slip out of place, thus adversely affecting the assembly work.

In U.S. Pat. No. 2,970,585, a pivotal ball-like portion was held tightly in position with a spherical concave surface of a hollow bolt, leaving little freedom for pivotal motion. Further in maintenance service, removal of the hollow bolt was also required, resulting in increased inconveniency.

In Japanese Utility Model Publication No. 40-16482, the rocker arm had, for connection with a push rod, a joint part consisting of a spherical concave portion and a ball-like portion. According to this Publication, the ball-like portion was held by being enveloped, in a spherically concaving manner, within a skirt portion of an adjust screw at the side of the rocker arm. In this respect, however, there were accompanied inconveniences, such as the extreme difficulty to be found in the practice of calking the skirt portion to envelope the ball-like portion in a smoothly pivotable manner, and the impossibility of separation therebetween, which was disadvantageous for maintenance service.

With the foregoing points in mind, the present invention has been achieved.

SUMMARY OF THE INVENTION

Accordingly, an object of the present invention is to provide a supporting structure for rocker arms for engine valves which permits a pivot to be firmly engaged in a receiving part therefor so that an integral engagement is held therebetween, without the fear of lift-off, over the entire range of engine operation, while achievng reduction of operational noise and prevention of lubricant leakage, as well as facilitation of assembly work.

According to the present invention, there is provided a supporting structure for rocker arms for engine valves including an engine having a cylinder head, a valve provided on the cylinder head and adapted for either of intake and exhaust purposes, a valve-operating mechanism for operating the valve, the valve-operating mechanism including a rocker arm abutting on the top of the valve, to thereby operate the valve, and a pivotal structure for pivotably supporting one end of the rocker arm. The pivotal structure comprises a ball-like portion, a spherical concave portion shaped in a form substantially correspondent to the ball-like portion and engaged with the ball-like portion, and an elastic member disposed at an aperture end of the spherical concave portion and adapted to hold the ball-like portion in the spherical concave portion.

The above and further features, objects and advantages of the present invention will more fully appear from the following detailed description of preferred embodiments of the invention when the same is read in conjunction with the accompanying drawings.

DETAILED DESCRIPTION OF THE PREFERRED EMBODIMENTS

Figure 1:
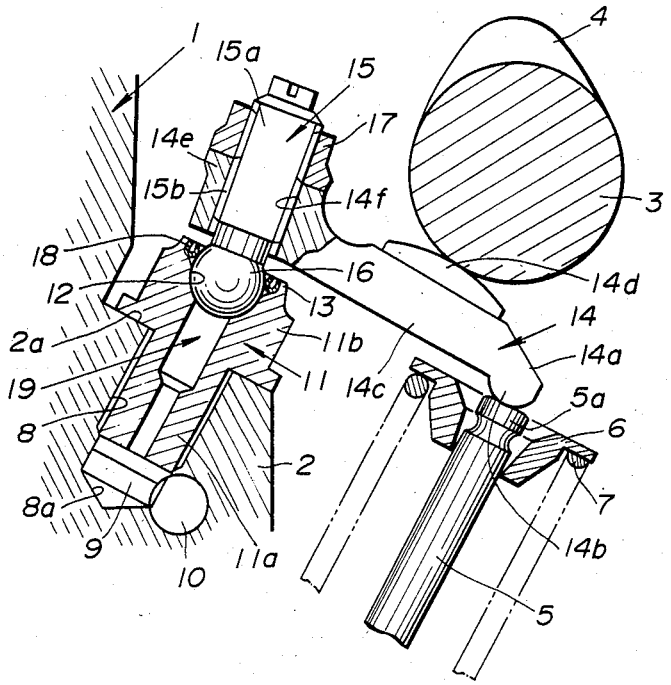
FIG. 1 is a longitudinal sectional view showing a first embodiment of the present invention.
Figure 2:
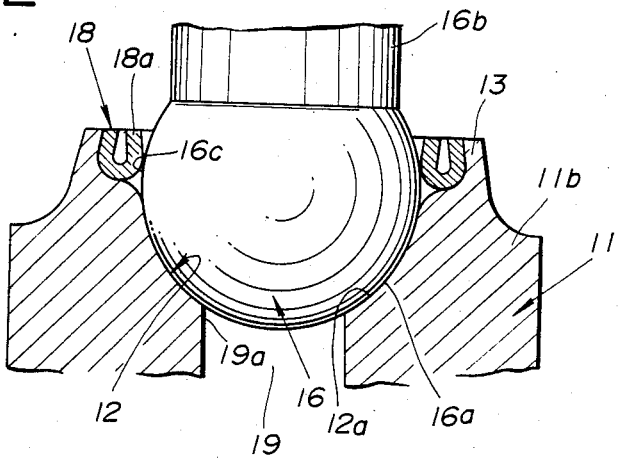
FIG. 2 is an enlarged longitudinal sectional view of an essential part of FIG. 1.

FIG. 1 is a longitudinal sectional view of a supporting structure according to a preferred embodiment of the present invention, as it is applied to a rocker arm for a valve of an internal combustion engine; and FIG. 2 is an enlarged longitudinal sectional view of an essential part of the supporting structure of FIG. 1.

In FIG. 1, designated at reference numeral 1 is a holder part as a supporting base formed on a cylinder head of the engine. The holder part 1 has formed therein an inclined fixing boss portion 2. In the upper diagonal portion of FIG. 1 there is disposed a cam shaft 3 with a cam 4 formed on a part thereof. Below the cam 4 is provided aslant a valve stem 5 for opening the valve, which valve is adapted for intake or exhaust purposes while the valve stem 5 is normally biassed upwards through the resiliency of a spring 7 acting thereon through a retainer 6 to thereby keep the valve closed.

The fixing boss portion 2 of the holder part 1 has an inclined seating surface 2*a* with a threaded fixing hole 8 perpendicularly bored therein. The hole 8 has defined above the bottom 8*a* thereof a communication chamber 9 communicating with a part of an oil path 10. Into the thus formed fixing hole 8 is screwed a threaded lower half part 11*a* of a pivot-receiving bolt 11. The bolt has formed, in a part thereof projecting over the seating surface 2*a*, a head 11*b* adapted for a tight-screwing operation thereof.

As shown in the enlarged view, FIG. 2, the head 11*b* is recessed to form in a central area of the upper surface thereof an upwardly opened spherically concave portion 12 which is radially outwardly expandingly stepped, along the upper edge of a spherical concave surface 12*a* thereof semi-circular in the side view, to have an annular projection 13 standing as the outer end part thereof, providing a radial gap between the inner circumference of the annular projection 13 and the upper edge of the spherical surface 12*a*.

In FIG. 1, designated by reference numeral 14 is the rocker arm as a component part of a valve-operating mechanism of the engine. The arm 14 has formed on the lower surface of a distal part 14*a* thereof an engagement portion 14*b* abutting on, to be engaged with, a top engagement portion 5*a* of the valve stem 5; and on the upper surface of an intermediate part 14*c* thereof a slipper portion 14*d* as a cam follower abutting on, to be engaged with, the cam 4 on the cam shaft 3.

In a base part 14*e* of the rocker arm 14 is formed a threaded through hole 14*f*. In the through hole 14*f* is screwed an adjust screw 15 consisting of an upper half portion 15*a* projecting over the base part 14*e* of the arm 14, on which portion 15*a* is screwed a lock nut 17 for locking it after the adjustment, and a lower half portion 15*b* screwed in the hole 14*f*. The adjust screw 15 further has, at a part thereof projecting under the base part 14*e* of the arm 14, a ball-like portion 16 shaped substantially in the form of a solid three-quarter sphere in this embodiment, which portion 16 is integrally joined at the upper part thereof with a neck or shaft portion 16*b* as a downward extension of the lower half portion 15*b* of the adjust screw 15. The ball-like portion 16 is fitted in, to be engaged with, the aforesaid spherical concave portion 12 of the pivot-receiving bolt 11, so that a spherical convex surface 16*a* of the former cooperates with the spherical concave surface 12*a* of the latter to thereby adapt the former to be slidingly pivotably guided by the latter.

Around the thus situated ball-like portion 16, more specifically between a lower portion 16*c* of the upper half part thereof and the annular projection 13, there is provided the radial gap as described, and in which gap is fitted a ring-like elastic member 18, substantially of a U-form in section in this embodiment. The elastic member 18 is first made as a molding of a synthetic resin, such as of a nylon, having a small coefficient of friction and is adapted to be clamped or deformed, after the fitting thereof into the aforesaid gap, by forcing under pressure the annular projection 13 to radially inwardly deform, to thereby push an inner strip 18*a* of the member 18 onto the lower portion 16*c* of the upper half part of the ball-like portion 16, so that this portion 16 is elastically pressed against the spherical concave portion 12.

Incidentally, the pivot-receiving bolt 11 is formed therethrough with a lube path 19 which is opened at the upper end thereof in the bottom central part of the spherical concave portion 12, providing therein a lubrication port 19*a* facing the ball-like portion 16, and at the lower end thereof to the communication chamber 9, thus communicating with the oil path 10. Accordingly, through the lube path 19, effective lubrication is achieved between the spherical concave portion 12 and the ball-like portion 16.

In the foregoing arrangement, the rocker arm 14 is adapted to swing or pivot, with rotation of the cam 4, about a pivotal mechanism consisting of the spherical concave portion 12 and the ball-like portion 16, to push down, with the engagement portion 14*b* at the distal part thereof, the valve stem 5 for opening the valve. Thereafter the stem 5 is to be returned to an original position thereof, with the resiliency of the spring 7, again closing the valve.

Figure 3:
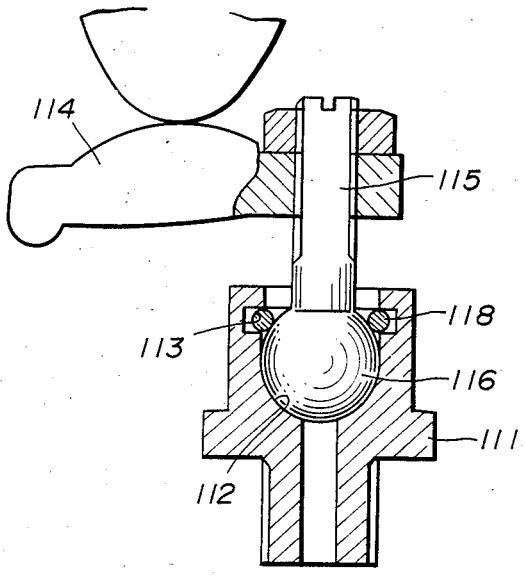
FIG. 3 is a longitudinal sectional view showing a second embodiment of the present invention.
Figure 4:
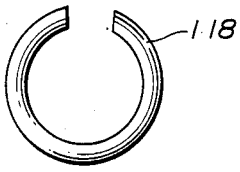
FIG. 4 is an explanatory plan view of an elastic member.

Referring now to FIGS. 3 and 4, there will be described hereinbelow a second embodiment of the present invention.

In this embodiment, also, an adjust screw 115 is provided at one end as a base part of a rocker arm 114 in a structure having a spherical concave portion 112 formed in a bore of a pivot-receiving bolt 111 on one hand, and a ball-like portion 116 formed at the lower end of the adjust screw 115 and fitted in the spherical concave portion 112 through the end opening of the bore on the other hand. Differently however, there is provided a clip member 118 shaped substantially in a C-form in the plan view as shown in FIG. 4 and fitted in an annular groove 113 formed as a radially outwardly sunk recess formed in a straight wall portion of the bore, or in other words fitted at the aperture end of the spherical concave portion 112, so that, with an oppression effect of the elastically contractive clip member 118, the ball-like portion 116 is normally downwardly pressed against the spherical concave portion 112.

Incidentally, in the foregoing embodiments of the present invention, the rocker arm 14 or 114 has a pivotal support therefor at the cylinder head side thereof. In this respect, however, the invention may be differently embodied such as for a rocker arm in which pivotal support is made between the distal part of the arm and a push rod. Moreover, in the second embodiment, the ball-like portion 116 may be simply held with a spherical concave surface, in a slip-off preventing manner, without being pressed thereagainst.

It should be well noted that, according to the foregoing embodiments, both the ring-like member 18 of U-form and the clip member 118 of C-form are elastically expansive and contractive in the radial directions thereof, so that, in the assembly or disassembly work, they can be attached or removed with small forces.

Figure 5:
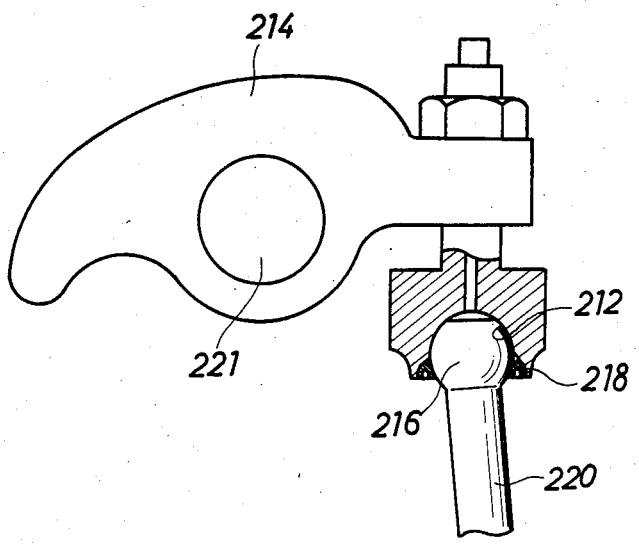
FIG. 5 is a longitudinal sectional view showing a third embodiment of the present invention.

Referring to FIG. 5, description will now be made of a third embodiment of the present invention.

In this embodiment, for a rocker arm 214 cooperating with a push rod 220 to constitute a valve-operating mechanism, while the rocker arm 214 is rockably mounted at the longitudinally central part thereof through a support shaft 221 on a cylinder head, there is provided a pivotal mechanism disposed between the rocker arm 214 and the push rod 220, which pivotal mechanism also has a ball-like portion 216 engaged in a spherical concave portion 212, and an elastic member 218 fitted at the aperture end of the spherical concave portion 212.

As will be understood from the foregoing description, according to the present invention, in a pivotal structure of a rocker arm, a ball-like portion is elastically pressed against a spherical concave portion to obtain resiliently oppressive contact between a spherical convex surface and a spherical concave surface, so that firm engagement can be achieved therebetween. Such engagement effectively avoids disengagement and leaping actions thereof even at high rotation speeds, thereby reducing the rate of occurrence of noise due to such disengagement or leaping actions, and thus favorably reducing the total noise level. Moreover, with such arrangement, the development of clearance between the ball-like portion and the spherical concave portion can be kept from becoming exessive, permitting effective suppression of lubricant leakage, thereby reducing oil consumption. Further, due to such restriction of the pivotal structure, the problem of the rocker arm slipping out of place in the assembly process is overcome, and thus assembly of such mechanisms, and the engines of which they are a part, is effectively facilitated.

Although there have been described what are at present considered to be the preferred embodiments of the invention, it will be understood that the present invention may be embodied in other specific forms without departing from the spirit or essential characteristics thereof. The present embodiments are therefore to be considered in all respects as illustrative and not restrictive. The scope of the invention is indicated by the appended claims rather than by the foregoing description.

We claim:

1. A supporting structure for rocker arms for engine valves, including:

an engine having a cylinder head;

a valve provided on said cylinder head and adapted for either of intake and exhaust purposes;

a valve-operating mechanism for operating said valve;

said valve-operating mechanism including a rocker arm abutting on the top of said valve, to thereby operate said valve; and a pivotal structure for pivotably supporting one end of said rocker arm, wherein said pivotal structure comprises:

a ball-like portion;

a spherical concave portion shaped in a form substantially correspondent to said ball-like portion and engaged with said ball-like portion; and an elastic member disposed within an aperture end of said spherical concave portion and adapted to hold said ball-like portion is said spherical concave portion.

2. A supporting structure according to claim 1, wherein: said pivotal structure is interposed between one end of said rocker arm and said cylinder head.

3. A supporting structure according to claim 1, wherein:

said valve-operating mechanism further includes a push rod fastened to one end of said rocker arm; and said pivotal structure is interposed between said one end of said rocker arm and said push rod.

4. A supporting structure according to claim 1, wherein: said elastic member is shaped in a ring-like form of a substantially U-shaped cross section.

5. A supporting structure according to claim 1, wherein: said elastic member is made of a synthetic resin having a relatively small coefficient of friction.

6. A supporting structure according to claim 1, wherein: said elastic member has a form radially inwardly deformed under pressure.

7. A supporting structure according to claim 2, wherein: said spherical concave portion is formed in a pivot-receiving bolt attached to said cylinder head.

8. A supporting structure according to claim 7, wherein: said pivot-receiving bolt has a lube path communicating with the inside of said spherical concave portion.

9. A supporting structure according to claim 2, wherein: said ball-like portion is formed at the end of a screw member attached to said rocker arm.

10. A supporting structure according to claim 1, wherein: said aperture end of said spherical concave portion is radially inwardly deformed around said elastic member.

11. A supporting structure according to claim 1, wherein:

said spherical concave portion has an annular groove formed near said aperture end; and said elastic member comprises a C shaped clip which is fitted in said annular groove.

* * * * *

UNITED STATES PATENT AND TRADEMARK OFFICE

CERTIFICATE OF CORRECTION

PATENT NO. : 4,658,770

DATED : April 21, 1987

INVENTOR(S) : Takahiro OKUYAMA et al.

It is certified that error appears in the above-identified patent and that said Letters Patent is hereby corrected as shown below:

Claim 1, line 20 (column 6, line 6), after "portion" change "is" to --in--.

Signed and Sealed this

Sixth Day of October, 1987

*Attest:*

DONALD J. QUIGG

*Attesting Officer*

*Commissioner of Patents and Trademarks*